US007372317B1

(12) United States Patent
Gerstenhaber et al.

(10) Patent No.: US 7,372,317 B1
(45) Date of Patent: May 13, 2008

(54) PTAT$^N$ BIAS CELL FOR IMPROVED TEMPERATURE PERFORMANCE

(75) Inventors: Moshe Gerstenhaber, Newton, MA (US); Sukhjinder S. Deo, Tewksbury, MA (US); Roxann Blanchard, Bedford, MA (US)

(73) Assignee: Analog Devices, Inc., Norwood, MA (US)

( * ) Notice: Subject to any disclaimer, the term of this patent is extended or adjusted under 35 U.S.C. 154(b) by 214 days.

(21) Appl. No.: 11/284,339

(22) Filed: Nov. 21, 2005

(51) Int. Cl.
*G05F 1/10* (2006.01)

(52) U.S. Cl. ..... 327/535; 327/513; 330/289

(58) Field of Classification Search ..... 327/512, 327/513, 534, 535, 537, 539, 543
See application file for complete search history.

(56) References Cited

U.S. PATENT DOCUMENTS 6,369,657 B2 4/2002 Dening et al.
6,946,913 B2 * 9/2005 Moriwaki et al. ..... 330/296
7,119,620 B2 * 10/2006 Pan ..... 330/289
7,245,182 B2 * 7/2007 Koizumi ..... 330/289

* cited by examiner

*Primary Examiner*—Jeffrey Zweizig
(74) *Attorney, Agent, or Firm*—Gauthier & Connors LLP

(57) ABSTRACT

A bias circuit is disclosed for use in a temperature compensation system. The bias circuit provides a current that is proportional to a temperature variation raised to an nth power where |n|>1 in accordance with an embodiment. In further embodiments, the bias circuit includes a PTAT current source for providing to a driver-stage amplifier a current that is substantially proportional to absolute temperature, and a CTAT current source for providing a current that is complementary to absolute temperature, wherein the PTAT and CTAT current sources coact to provide a PTAT$^2$ reference current that is proportional to an absolute temperature variation to the nth power wherein |n|>1.

15 Claims, 4 Drawing Sheets

PTAT$^N$ BIAS CELL FOR IMPROVED TEMPERATURE PERFORMANCE

BACKGROUND

The invention relates to temperature compensation systems, and relates in particular to temperature compensation systems for linear power amplifiers that include power transistors.

The requirements of a bias circuit for a power transistor are typically quite different from that of a small-signal gain stage. First, the bias circuit should be able to provide sufficient DC base current. Second, linear power amplifiers are usually class AB type for efficiency reasons and this makes achieving constant gain between small and large signal conditions difficult to achieve. This is a requirement for good linear performance. Further, it is typically observed that power amplifier gain exhibits different variation over temperature under small signal and full power operation. A good bias circuit should minimize this effect. A poor bias circuit may result in so much gain drop at high temperature that the power amplifier might be able to deliver only half of its rated power at the extremes of temperature. In general, gain drops with increasing temperature if bias current is kept constant. A gain drop may even be significant for a power amplifier in which the bias current is PTAT (Proportional To Absolute Temperature).

Some of the reasons for these problems are that a PTAT bias current ($I_C$) helps to keep emitter charging time ($r_E$, $C_{JE}$) constant with temperature, where $r_E=(kT/qI_C)$. Device gain, however, which is directly proportional to $f_r$, is determined by total emitter to collector transit time, and not only by emitter charging time. The values $\tau_B$ (minority carrier drift-diffusion base time constant), $\tau_{SCL}$ (collector space charge layer delay time) and $\tau_{CIB}$ (carrier diffusion time through 'current-induced-base' width $W_{CIB}$) are significant contributors to the emitter-collector transit time at high frequencies and high current densities. When the power amplifier is delivering near full power; these high current density effects kick in and modify the temperature dependence of these device parameters. In other words, self-heating of the power transistor at high currents decreases the saturation velocity in the collector-base depletion region and the electron mobility in the base, which result in increase in $\tau_{CIB}$ and $\tau_B$. This is the primary reason for higher rate of gain drop with temperature when the power amplifier is delivering near full power.

Another problem is that, to achieve better efficiency most linear power amplifiers are class AB type and therefore exhibit self-biasing. This means that DC bias, the temperature dependence of which is controllable, is only one part of the total bias. The rest of it comes from the radio frequency (RF) signal itself. If driver-stage gain drops with temperature therefore, it will directly result in reduced gain of the power-stage at elevated temperatures. The DC bias for the power stage should then be able to compensate for this effect.

Certain power amplifiers have employed a variety of approaches to correct for these problems. For example, U.S. Pat. No. 6,369,657 discloses various systems that employ one or more of resistive biasing, active biasing and a current mirror bias network. These solutions primarily result in providing some form of PTAT current through the power transistor, but have been found to not fully compensate for temperature in all applications.

There is a need, therefore, for an improved temperature compensation system for power amplifiers.

SUMMARY

The invention provides a bias circuit for use in a temperature compensation system. The bias circuit provides a compensation current that is proportional to a temperature variation raised to an nth power where $|n|>1$ in accordance with an embodiment. In further embodiments, the bias circuit includes a PTAT current source for providing to a driver-stage amplifier a current that is substantially proportional to absolute temperature, and a CTAT current source for providing a current that is complementary to absolute temperature, wherein the PTAT and CTAT current sources coact to provide a PTAT$^n$ reference current that is proportional to an absolute temperature variation to the nth power wherein $|n|>1$.

BRIEF DESCRIPTION OF THE DRAWINGS

The following description may be further understood with reference to the accompanying drawings in which.

The drawings are shown for illustrative purposes only.

DETAILED DESCRIPTION OF THE ILLUSTRATED EMBODIMENTS

Applicants have discovered that to minimize gain variation of the power amplifier over temperature the quiescent current of the power-stage should increase in approximate proportion to the square-power of temperature.

Circuits in accordance with certain embodiments of the invention may be implemented for a power amplifier bias that uses the principle of translinear current multiplication to obtain a bias current proportional to square of absolute temperature (PTAT$^2$). This type of bias for a power transistor results in less gain variation of the power amplifier over the operating temperature and the circuit is capable of meeting the DC base current requirements of the power transistor. Typically for a two stage power amplifier, a PTAT current is more suitable for driver stage and PTAT$^2$ for the power stage.

Figure 1:
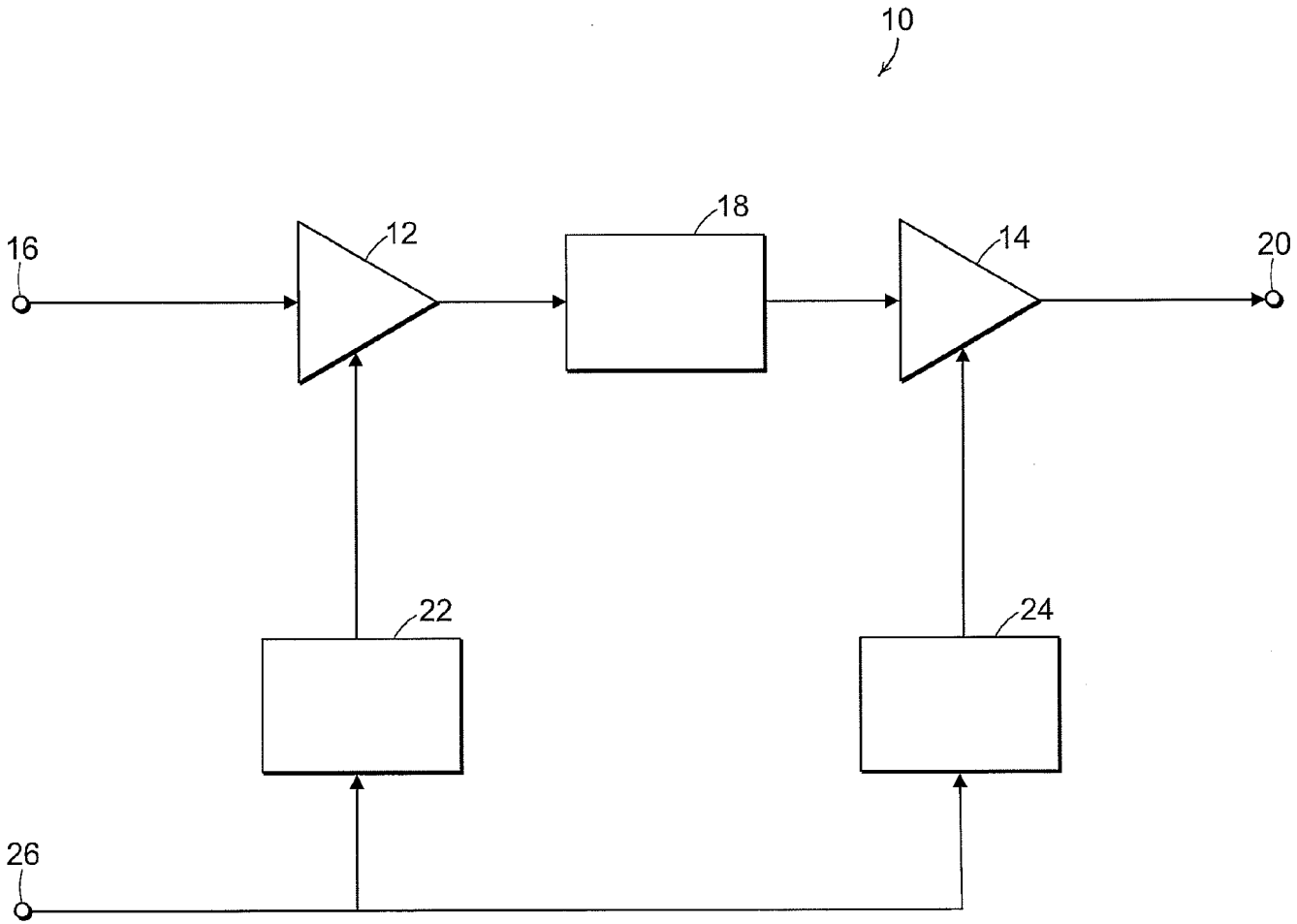
FIG. 1 shows an illustrative diagrammatic functional view of a temperature compensation system in accordance with an embodiment of the invention.

As shown in FIG. 1, a two stage power amplifier system 10 that includes a bias cell in accordance with an embodiment of the invention includes a driver-stage amplifier 12 and a power-stage amplifier 14 of a linear power amplifier. The driver-stage amplifier 12 receives an RF input signal from an input node 16 and the output of the driver stage is provided to a matching network 18. The output of the matching network 18 is provided to the power-stage amplifier 14, and the output of the power-stage amplifier 14 is provided at an RF output node 20. The system 10 also includes a bias network including a PTAT bias circuit 22 and a PTAT$^2$ bias circuit 24. The PTAT bias circuit 22 that receives a Vreg signal from a Vreg node 26 and is coupled to the driver-stage amplifier 12. The $PTAT^2$ bias circuit 24 also receives the Vreg signal and is coupled to the power-stage amplifier 14.

Figure 2:
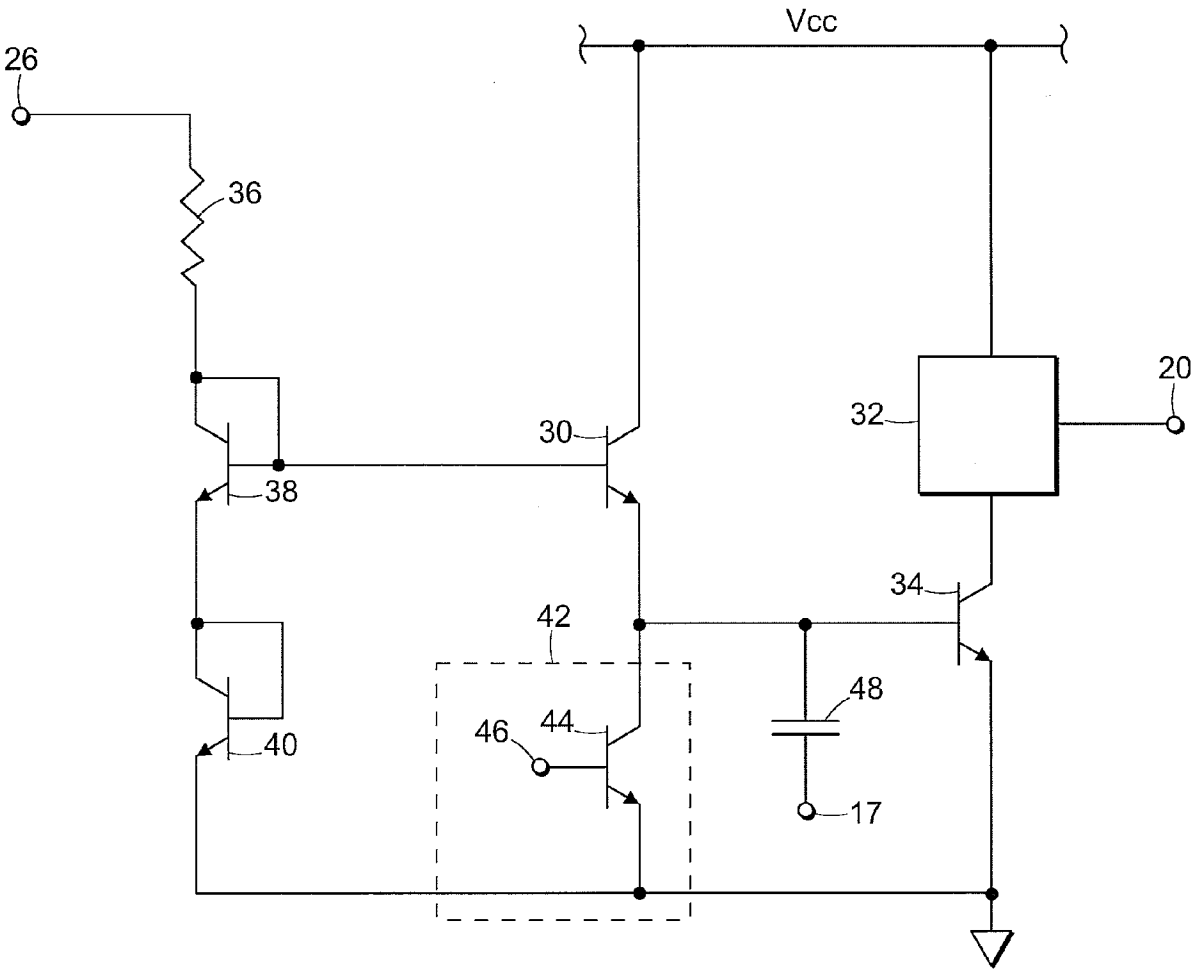
FIG. 2 shows an illustrative diagrammatic view of a circuit for a temperature compensation system in accordance with another embodiment of the invention.

During operation, the system provides a PTAT bias signal to the driver-stage amplifier 12 and provides a $PTAT^2$ bias signal to the power-stage amplifier 14. As shown in FIG. 2, a particular implementation of a system that includes a $PTAT^2$ bias cell in accordance with an embodiment includes a driver-stage transistor 30, an output matching network 32, and a power-stage transistor 34. The base of the transistor 30 is biased at 2 Vbe by diode connected transistors 38 and 40, which are biased at PTAT current provided through resistor 36 from an appropriate voltage at node 26. In other embodiments, diode connected transistors 38, 40 may be biased using a PTAT current from a variety of other sources. The collector of the transistor 30 is coupled to $V_{CC}$, while the emitter of the transistor 30 is coupled to the base of the power-stage transistor 34. The emitter of the power-stage transistor 34 is coupled to ground while the collector of the power-stage transistor 34 is coupled to the output matching network 32. The output matching network is also coupled to $V_{CC}$, and the output of the matching network 32 is provided to an RF output node 20.

The system of FIG. 2 also includes a zero-dependence on absolute temperature (ZTAT) current source 42 that includes a transistor 44, the base of which is biased at node 46. The emitter of the transistor 44 is coupled to ground, while the collector of the transistor 44 is coupled to the emitter of the transistor 30. During operation, a ZTAT current through the transistor 44 ensures that a $PTAT^2$ current will pass through the transistor 34. The base to emitter voltage of the power-stage transistor 34 ($V_{BE32}$) plus the base to emitter voltage of the transistor 30 ($V_{BE30}$) should be equal to the sum of the base to emitter voltages of the transistors 38 and 40 ($V_{BE38}$+$V_{BE40}$). The current, therefore, through the transistor 34 ($I_{34}$) should be equal to the product of the currents through the transistors 38 and 40, which are a function of temperature T ($I_{38}(T)\cdot I_{40}(T)$), divided by the current through the transistor 44 ($I_{44}(T)$), or $$I_{34}=(I_{38}(T)I_{40}(T))/I_{44}(T)$$

The current drawn through the power-stage transistor 34, therefore, may be on the order of the square of the temperature ($I_O \propto T^2$). The above analysis excludes base currents. The base current of the transistor 34 (which is supplied by the transistor 30) is the most significant base current. Increasing the current into the collector of the transistor 44 may reduce any error that is introduced by the base current of the transistor 34.

Figure 3:
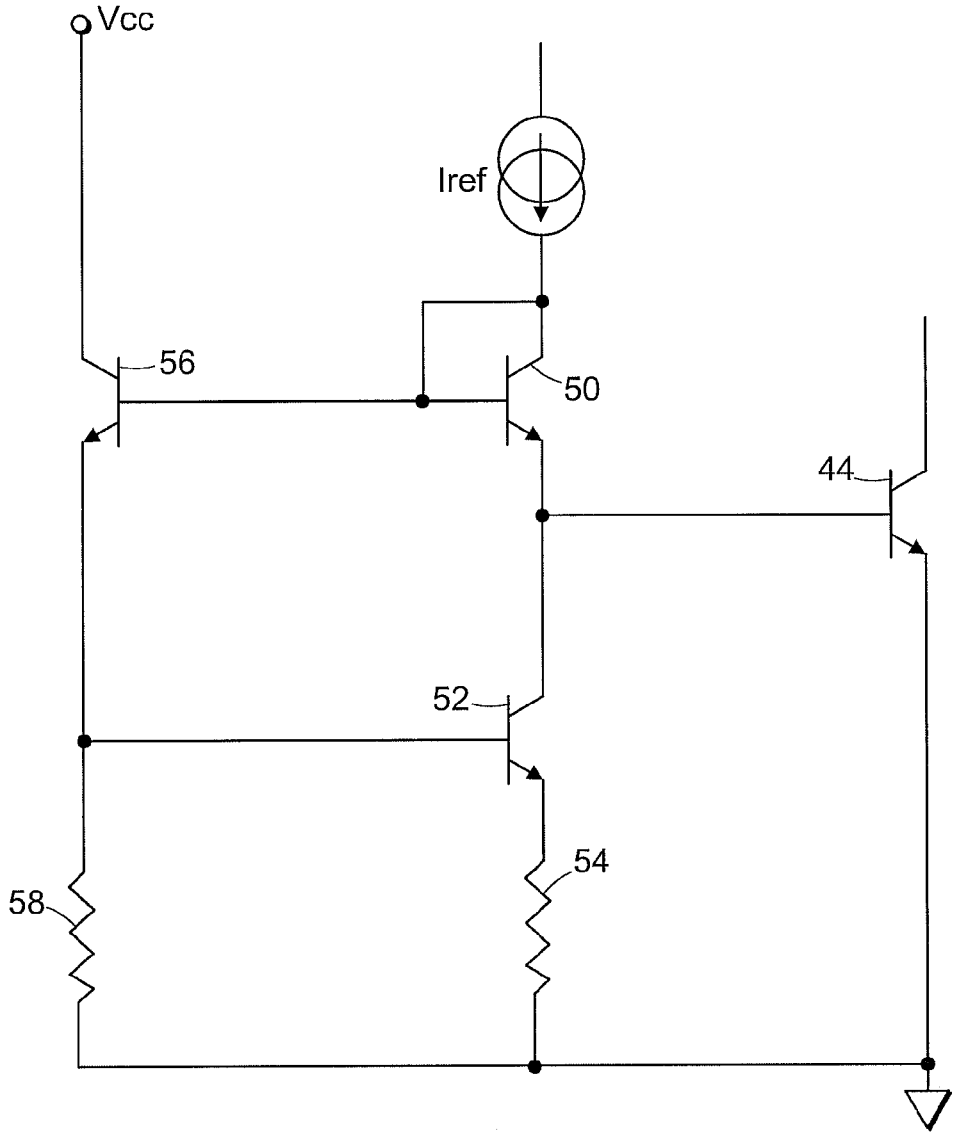
FIG. 3 shows an illustrative diagrammatic view of another circuit for a temperature compensation system in accordance with a further embodiment of the invention.

The voltage at node 46 may be provided by a variety of systems. For example, FIG. 3 shows a circuit that results in a ZTAT current through transistor 44. In particular, the circuit includes a transistor 50 whose collector and base are commonly coupled to the current source $I_{ref}$ as well as the base of a transistor 56. The collector of the transistor 56 is coupled to Vcc, and the emitter of the transistor 56 is coupled to the base of a transistor 52 as well as a resistor 58, the other side of which is coupled to ground. The emitter of the transistor 50 is coupled to the collector of the transistor 52 as well as to the base of a transistor 44. The emitter of the transistor 52 is coupled to ground via a resistor 54. Transistor 44 would replace the current source represented by transistor 44 in FIG. 2.

During operation, a reference current ($I_{ref}$) drives the transistor 50 (that is wired as a diode) and passes through a second transistor 52, then through a resistor 54 prior to reaching ground. Another current is generated in resistor 58 that will pass through transistor 56 to Vcc. If the value of the resistor 54 is set to zero, then $V_{BE44}$+$V_{BE50}$ will equal $V_{BE52}$+$V_{BE56}$. With the resistor 54 set to zero therefore, the base to emitter voltages of the transistors 56 and 44 would be the same. This is because the base to emitter voltages of transistors 50 and 52 should be the same as one another since the same current is passing through both transistors. The current through the collector of the transistor 44 ($I_{44}$) is therefore, proportional to the current through the transmitter 56 ($I_{56}$).

The current $I_{56}$ is set by $V_{BE52}$ and the value of the resistor 58. If the value of the resistor 54 is set to zero, the current $I_{56}$ is slightly complementary to absolute temperature (CTAT) as is $I_{44}$. Adding a small value of resistance at resistor 54 results in approximately ZTAT current through transistor 44.

Since $I_{ref}\cdot R_{54}+V_{BE52}+V_{BE56}=V_{BE50}+V_{BE44}$, then $V_{BE44}=V_{BE56}+I_{ref}\cdot R_{54}$. If $R_{54}$ is made small, then $I_{44}\infty I_{56}$. The CTAT value is provided by $V_{BE52}$ and $R_{58}$ while the PTAT value is provided by $I_{ref}$ and $R_{54}$ The current through transistor 56 ($I_{56}$), therefore may be expressed as:

$$I_{56} = \frac{V_{BE52} + I_{ref} \cdot R_{54}}{R_{58}}$$

By appropriate selection of $R_{54}$, the current $I_{44}$ may approximate CTAT ($R_{54}$~zero) or ZTAT ($R_{54}$ very small). Referring to FIG. 2, a ZTAT/CTAT current in the transistor 44 would result in $PTAT^2/PTAT^3$ current in transistor 34.

Figure 4:
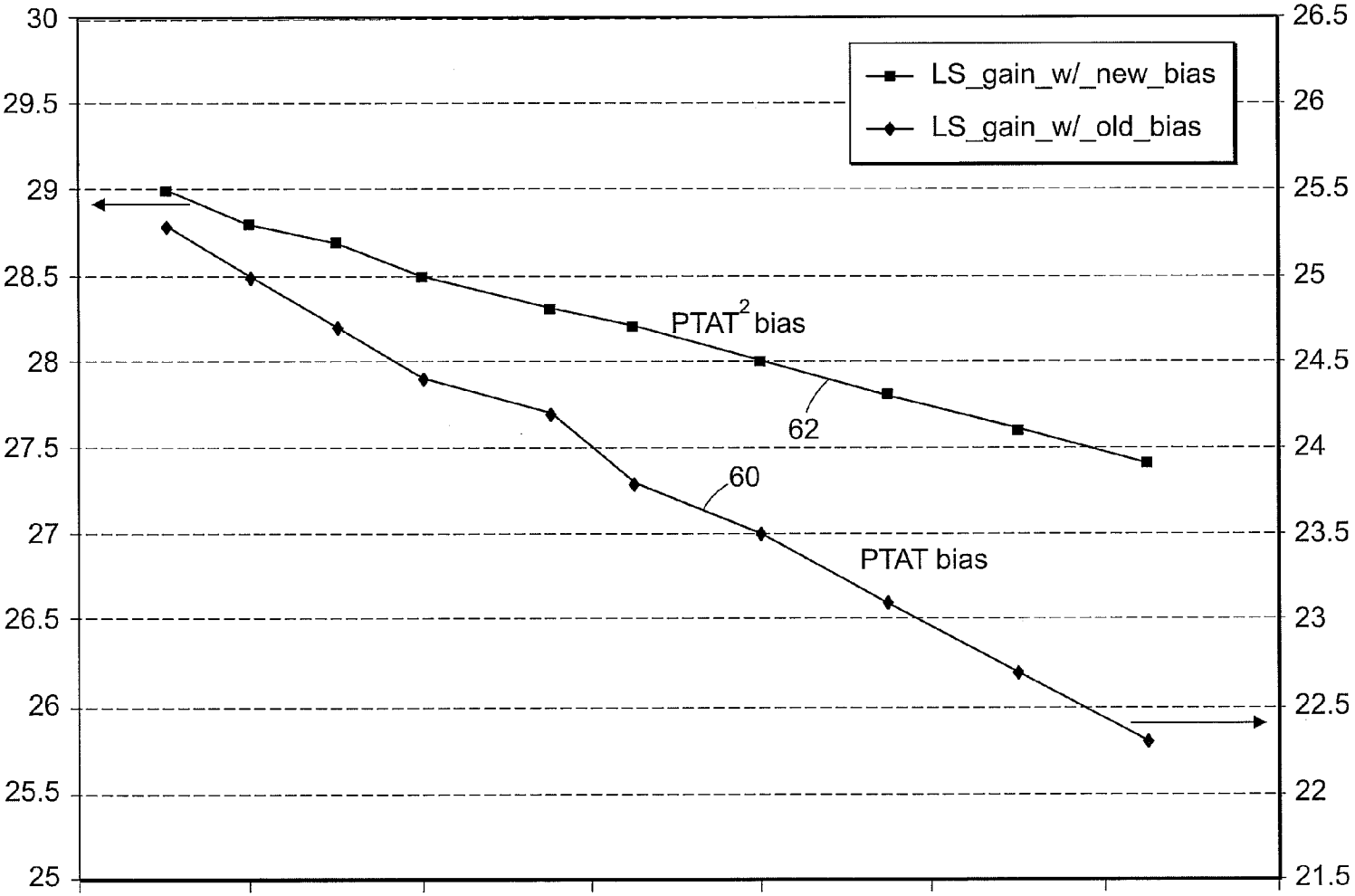
FIG. 4 shows an illustrative graphical representation of temperature versus power amplifier gain for systems various embodiments of the invention.

As shown in FIG. 4, the temperature versus gain relationship for the PTAT bias (shown at 60 and scaled on the right side) may not be sufficiently linear for certain applications, while the temperature versus gain relationship for the $PTAT^2$ bias (shown at 62 and scaled on the left side) is much more linear, FIG. 4 shows that the power amplifier gain for the $PTAT^2$ system experiences less of a drop (about 1.6) than for the PTAT system (about 3.0) over a temperature range of about −30° C. up to about 85° C.

Although n-p-n transistors are used in the above discussed circuits, circuits in accordance with invention may also be created using p-n-p transistors, or any other type of transistors such as hetero-bipolar transistors (HBT), hetero-junction transistors (HJT) metal-on-oxide transistors (MOS and CMOS), field effect transistors (FET), as well as any other type of known or later developed transistors.

In accordance with various embodiments therefore, the invention provides a $PTAT^2$ bias cell for improved temperature compensation of a GaAs HBT Linear Power Amplifiers as discussed above, as well as Si BJT and CMOS devices. The bias cell of the invention may find applications in other technologies such as but not limited to power amplifiers using Si, SiGe and InP as well as applications other than for power amplifiers.

Those skilled in the art will appreciate that numerous modifications and variations may be made to the above disclosed embodiments without departing from the spirit and scope of the invention.

What is claimed is:

1. A bias circuit for use in a temperature compensation system wherein said bias circuit provides a compensation current that is proportional to a temperature variation raised to an nth power where $|n|>1$, wherein said bias circuit includes a complementary-to-temperature (CTAT) source and a proportional-to-temperature (PTAT) source.

2. The bias circuit as claimed in claim 1, wherein n=2.

3. The bias circuit as claimed in claim 1, wherein said bias circuit is used to provide the bias for a linear power amplifier and to have improved gain stability over temperature.

4. The bias circuit as claimed in claim 1, wherein said circuit further includes means for generating at least one of a CTAT current and a zero-dependence-on-absolute-temperature (ZTAT) current responsive to a change of a resistor.

5. The bias circuit as claimed in claim 4, wherein a value of said resistor may be chosen to achieve a desired power n.

6. A bias circuit for use in a temperature compensation system for an amplification system, said bias circuit comprising:

a PTAT current source for providing a current that is substantially proportional to absolute temperature;

a CTAT current source for providing a current that is substantially complementary to absolute temperature; wherein said PTAT and CTAT current sources coact to provide a $PTAT^n$ reference current that is proportional to an absolute temperature variation to the $n^{th}$ power where $|n|>1$.

7. The bias circuit as claimed in claim 6, wherein said CTAT current source further includes means for providing a ZTAT current responsive to a change of a resistor.

8. The bias circuit as claimed in claim 6, wherein said amplification system includes a driver-stage amplifier that is coupled to said PTAT current source.

9. The bias circuit as claimed in claim 6, wherein said PTAT current source includes two diode-wired transistors in series.

10. The bias circuit as claimed in claim 6, wherein said PTAT current source includes a first transistor and said CTAT current source includes a second transistor, wherein the base of the first transistor is coupled to the base of the second transistor.

11. The bias circuit as claimed in claim 6, wherein the resistor values may be adjusted to achieve a desired power n.

12. A bias circuit for use in a temperature compensation system for an amplification system including a driver-stage amplifier and a power-stage amplifier, said bias circuit comprising:

PTAT current source for providing a PTAT current through a first transistor that is substantially proportional to absolute temperature; and a $PTAT^n$ current source for providing a bias current for a power-stage transistor.

13. The bias circuit as claimed in claim 12, wherein said circuit further includes a resistor that is coupled in series between an emitter of a third transistor and ground.

14. The bias circuit as claimed in claim 13, wherein the value of said resistor may be changed to provide a desired power n.

15. The bias circuit as claimed in claim 12, wherein n=2.

* * * * *